US006273194B1

(12) United States Patent
Hiron et al.

(10) Patent No.: US 6,273,194 B1
(45) Date of Patent: Aug. 14, 2001

(54) METHOD AND DEVICE FOR DOWNHOLE FLOW RATE CONTROL

(75) Inventors: Stéphane Hiron, Igny; Vincent Tourillon, Paris, both of (FR); Christophe Rayssiguier, Houston, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 0 days.

(21) Appl. No.: 09/517,596

(22) Filed: Mar. 2, 2000

(30) Foreign Application Priority Data

Mar. 5, 1999 (FR) ..... 99 02777

(51) Int. Cl.[7] ..... E21B 34/10; E21B 34/14
(52) U.S. Cl. ..... 166/373; 166/332.1
(58) Field of Search ..... 166/373, 363, 166/332.3, 332.1, 334.4, 72

(56) References Cited

U.S. PATENT DOCUMENTS 3,696,868 * 10/1972 Taylor, Jr. ..... 166/315
4,105,069 * 8/1978 Baker ..... 166/51
4,271,903 * 6/1981 Slagle, Jr. et al. ..... 166/129
5,287,930 * 2/1994 McGill ..... 166/373
5,299,640 4/1994 Streich et al. .
5,479,989 * 1/1996 Shy et al. ..... 166/332.4
5,831,156 * 11/1998 Mullins ..... 73/152.18
5,957,208 * 9/1999 Schnatzmeyer ..... 166/373

FOREIGN PATENT DOCUMENTS

WO97/30269 8/1997 (WO) .
WO97/37102 10/1997 (WO) .

* cited by examiner

*Primary Examiner*—Frank S. Tsay
(74) *Attorney, Agent, or Firm*—Jeffrey Griffin; Jaime Castano

(57) ABSTRACT

A flow rate control device (18) placed down an oil well in production comprises holes (24) formed in the production tubing (16), a closure sleeve (26) suitable for sliding facing the holes (24), an actuator (31) disposed eccentrically relative to the tubing (16), and an intermediate part (29). The intermediate part (29) is guided on the tubing (16) in a manner such as to withstand the tilting torque due to the eccentricity of the actuator (31). A coupling (46) that is flexible except in the direction in which the sleeve is moved connects the part (29) to the closure sleeve (26) symmetrically about the axis of the tubing (16). The resulting decoupling guarantees that the sleeve (26) is self-centering, which improves the life-span of the device (18) significantly.

21 Claims, 4 Drawing Sheets

METHOD AND DEVICE FOR DOWNHOLE FLOW RATE CONTROL

TECHNICAL FIELD

The present invention relates to a method and a device designed to control the downhole flow rate of a petroleum fluid flowing via production tubing.

Such a device may, in particular, be used in an oil well in production to optimize the production of the well over time. It is particularly applicable to the case when the petroleum fluid penetrates into a vertical, horizontal, or deviated well at at least two different locations.

STATE OF THE ART

It is known that adjustable flow rate valves can be placed down a well in production, in particular in order to optimize production when the petroleum fluid flows into the well at at least two spaced-apart locations. Documents GB-A-2 314 866 and WO-A-97/37102 relate to such adjustable flow rate valves.

Adjustable flow rate valves are installed on the production tubing so as to define a passage of adjustable section between the inside of the tubing and the annular space surrounding it. Such a valve commonly comprises a slidably-mounted closure sleeve placed inside the production tubing, and holes formed in the tubing at the level of the sleeve. Such valves further comprise actuators controlled remotely from the surface so as to move the closure sleeve parallel to the axis of the production tubing.

Usually, the actuator of an adjustable flow rate valve comprises an electrical actuator or a hydraulic actuator placed outside the production tubing and parallel to the axis thereof. The drive rod of the actuator is then fixed to a lug secured to or integral with the closure sleeve.

In such a conventional configuration, since the actuator is placed outside the production tubing while the closure sleeve is coaxial therewith, the mechanism is asymmetrical. The thrust force or the traction force exerted on the closure sleeve therefore generates torque which tends to cause the sleeve to tilt. Such tilting torque gives rise to friction between the sleeve and the production tubing. As a result, two reaction forces acting in opposite radial directions are applied to each of the ends of the sleeve. The reaction forces compensate for the tilting torque (radial components) but they also tend to oppose the movement in translation of the sleeve (axial components). The axial forces are proportional to the coefficient of friction between the two materials constituting the sleeve and the production tubing.

That purely mechanical effect is accentuated by the particularly unfavorable conditions that prevail at the bottom of the well, and that generally cause a deposit to form on the production tubing. In the presence of such a deposit, the front end of the closure sleeve (for a given sleeve displacement direction) is subjected to wedging caused by the deposit, at a place diametrically opposite from the force exerted by the actuator. Conversely, the front end of the sleeve must remove the deposit formed on the tubing in its portion situated on the same side as actuator.

That effect due to the deposit combines with the tilting effect due the asymmetrical nature of the mechanism to make it particularly difficult to cause the closure sleeve to move. It is thus necessary to use a very powerful actuator whenever a deposit tends to form on the production tubing, which occurs very frequently in an oil well. Very rapidly, the actuator can become too weak to drive the sleeve, and the mechanism seizes. The reliability of flow rate control devices designed in that way is thus poor.

Another problem that arises with adjustable flow rate vales of that type concerns their fluid-tightness when they are in the closed state. Fluid-tightness is generally obtained by means of two dynamic sealing gaskets mounted on the production tubing on either side of the holes passing through said tubing. When the valve is in the closed state, the closure sleeve extends across the holes and co-operates normally in fluid-tight manner with the two sealing gaskets.

Because of the asymmetrical nature of the mechanism, the closure sleeve is not exactly concentric with the production tubing. In particular, each time the sleeve moves, it tilts slightly in one or other direction depending on the direction of movement, as observed above. Thus, when the valve is caused to open starting from its closed state, the gasket situated frontmost relative to the direction of movement of the sleeve is compressed excessively on the side on which the actuator is situated, whereas it is not compressed sufficiently on the opposite side. The reverse applies to the gasket situated rearmost, which gasket is subjected to excessive compression on the side opposite from the actuator , while being insufficiently compressed on the side on which the actuator is situated. The respective over-compressed and under-compressed portions of the gaskets are reversed when the closure sleeve returns to the state in which the device is closed. The gaskets are therefore subjected to cycles of excessive compression and of insufficient compression, thereby accelerating ageing of said gaskets. Risks of leakage thus appear rapidly in the regions in which the gaskets are insufficiently compressed while the closure sleeve is moving.

This analysis shows that the current design of adjustable flow rate valves placed down wells is not satisfactory from the point of view of reliability. That goes against the function that such valves are supposed to perform, which is to provide optimized oil well management. Any maintenance on such adjustable flow rate valves is costly (removal and re-insertion of the production tubing), and it results in production being interrupted, which causes the yield of the well to drop.

SUMMARY OF THE INVENTION

According to the invention, there is provided a flow rate control device for controlling the flow rate through production tubing placed in an oil well, the device comprising at least one hole formed in the production tubing, a closure sleeve slidably-mounted facing said hole, and drive means mounted eccentrically on the production tubing and suitable for moving the sleeve over a given path, said drive means acting on the sleeve via at least one intermediate part which co-operates with the production tubing via guide means that define said path, and that co-operate with the sleeve via coupling means that are flexible except along said path, and that are disposed symmetrically about the axis of the production tubing.

In such a device, the intermediate part and the flexible coupling means interposed between said part and the sleeve decouple the coupling between the drive means and the sleeve. The sleeve thus centers itself on the axis of the production tubing and it is not subjected to any tilting torque. For the same force exerted by the drive means, much greater reliability is thus obtained. In addition, the sealing means carried by the production tubing are subjected to compression forces that are constant and uniform, and that increase the life-span of the sealing means very significantly.

In a preferred embodiment of the invention, the path over which the sleeve moves is parallel to the axis of the production tubing.

In addition, the drive means advantageously act on the intermediate part via a drive rod extending parallel to the axis of the production tubing.

In which case, the coupling means are preferably installed at two places disposed symmetrically about the axis of the production tubing, in a first plane containing said axis and lying perpendicular to a second plane containing both said axis and also the axis of the drive rod.

In the preferred embodiment of the invention, the drive means, the intermediate part and the closure sleeve are mounted outside the production tubing.

The intermediate part is then advantageously connected to the production tubing by guide means so that circumferential clearance is provided between the tubing and the intermediate part. This characteristic makes it possible to prevent any deposit present on the tubing from hindering the movement of the intermediate part. Thus, the system is made more efficient, which makes it possible to limit the forces exerted by the actuator.

In addition, the guide means preferably comprise two pairs of guide members, the guide members in each pair being spaced apart along the axis of the production tubing, and the pairs being disposed in the first plane at diametrically opposite places on said tubing.

Each guide member then advantageously comprises a cylindrical rod which projects radially outwards from the production tubing through a straight slot formed in the intermediate part, and a base of relatively larger diameter, whose height determines the circumferential clearance.

In a variant, the guide means comprise two spaced-apart guide parts fixed to the production tubing and in which slideways are formed, the intermediate part being provided with arms which pass through said slideways, and each guide part supporting at least one pin which passes across said slideway and through a straight slot formed in the arm received in said slideway.

The intermediate part may be implemented either in the form of a single part that is C-shaped in section, or in the form of two parts that are symmetrical about the second plane, the part or parts being mounted on the production tubing.

Advantageously, a protective sleeve is mounted in alignment with the closure sleeve, and is urged theretowards by resilient means, so as to bring the protective sleeve automatically into a covering position in which it covers sealing means mounted on the production tubing, on that side of the hole which is further from the drive means, when said sealing means are not covered by the closure sleeve.

The invention also relates to a method of controlling the flow rate through production tubing placed in an oil well, in which method a moving closure sleeve is moved along a given path facing at least one hole passing through the production tubing under the action of drive means mounted eccentrically on said tubing, said method being characterized in that the drive means act on the sleeve via at least one intermediate part which is guided on the tubing along said path, and which is connected to the sleeve, the connection being flexible, except along said path, and symmetrical about the axis of the production tubing.

BRIEF DESCRIPTION OF THE DRAWINGS

A preferred embodiment of the invention is described below by way of non-limiting example and with reference to the accompanying drawings, in which.

DETAILED DESCRIPTION OF A PREFERRED EMBODIMENT OF THE INVENTION

Figure 1:
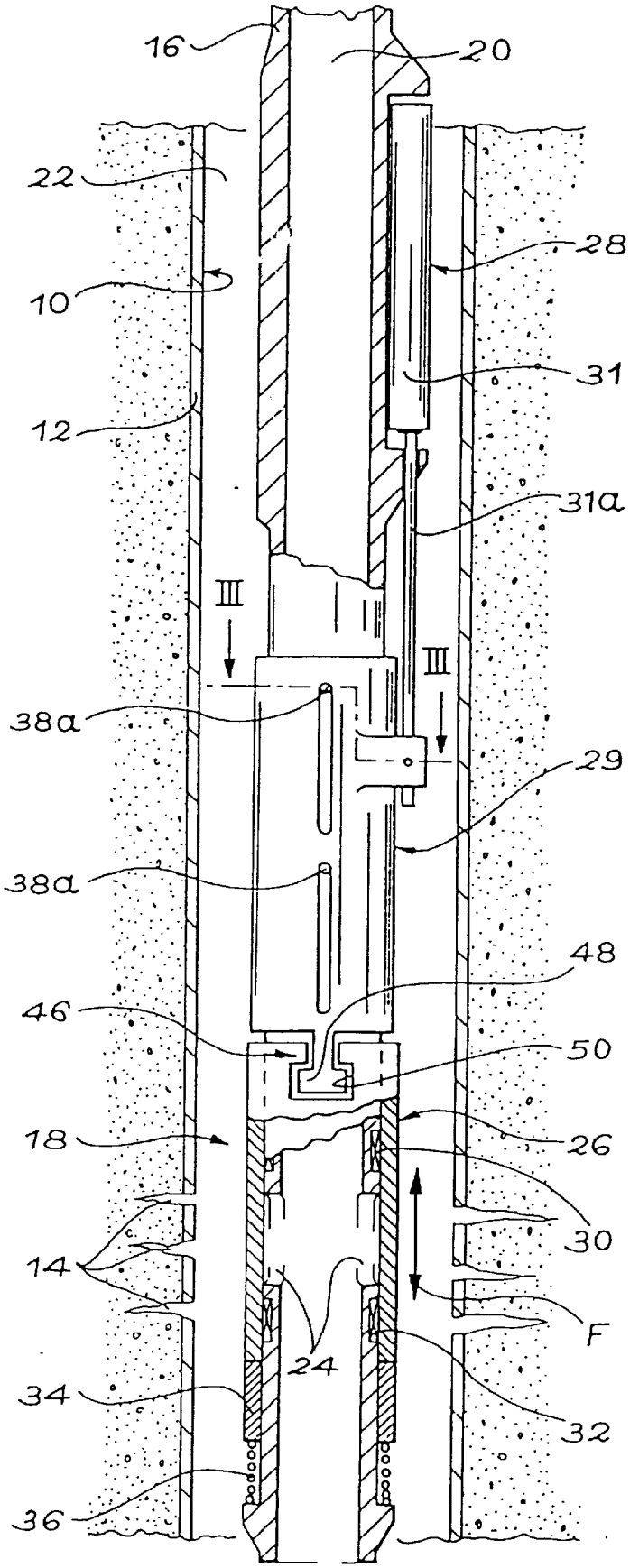
FIG. 1 is a diagrammatic longitudinal section view of a flow rate control device of the invention, as installed in the bottom of an oil well.

In FIG. 1, reference 10 designates an oil well in production, only a bottom region of which is shown. It should be noted that said bottom region may extend vertically, as shown, or horizontally, or on a slope, without going beyond the ambit of the invention. When the flow rate control device is placed in a horizontal or deviated region of a well, the expressions such as "downwards" and "upwards" used in the following description then mean respectively "away from the surface" and "towards the surface".

The walls of the oil well 10 are reinforced with casing 12. In the region of the well shown in FIG. 1, the casing 12 is perforated at 14 so as to cause the well to communicate with a natural deposit of petroleum fluid (not shown).

To enable the petroleum fluid to be conveyed to the surface, production tubing 16 is received coaxially in the well 10 over its entire depth. The production tubing 16 is made up of a plurality of tubing segments interconnected end-to-end. One of the segments, shown in FIG. 1, forms the body of the flow rate control device 18 of the invention. To simplify the description, the expression "production tubing" is used below to cover both the entire string of tubing, and also the segment of tubing forming the body of the device 18.

Internally, the production tubing 16 defines a channel 20 via which the petroleum fluid rises towards the surface. The annular space 22 defined between the production tubing 16 and the casing 12 of the well 10 is closed, on either side of the flow rate control device 18 by annular sealing systems (not shown). Therefore, the petroleum fluid coming from the natural deposit (not shown) and admitted into the well via the perforations 14 can rise to the surface via the central channel 20 only by flowing through the flow rate control device 18.

Essentially, the flow rate control device 18 comprises at least one hole 24 formed in the production tubing 16, a closure sleeve 26, drive means 28, and an intermediate part 29.

In practice, the flow rate control device 18 comprises a plurality of holes 24 distributed uniformly over the entire circumference of the production tubing 16. For example, each of the holes 24 has a shape that is elongate in the axial direction of the tubing. The holes 24 may however be of any number or of any shape without going beyond the ambit of the invention.

The closure sleeve 26 is mounted on the production tubing 16 in a manner such that it can move parallel to the axis of the production tubing. More precisely, the closure sleeve 26 is suitable for moving between a "bottom" or "front" position, corresponding to the flow rate control device 18 being closed, and a "top" or "rear" position, corresponding to the device 18 being fully open. Between these two extreme positions, the closure sleeve 26 may be moved continuously so as to vary the through section of the flow rate control device 18 and, as a result, so as to vary the flow rate of the petroleum fluid flowing through the device.

The drive means 28 comprise an actuator 31 mounted eccentrically outside the production tubing 16. This actuator 31 may be of the electromechanical type or of the hydraulic type, and it is suitable for moving the closure sleeve 26 continuously and in controlled manner parallel to the axis of the production tubing 16, via the intermediate part 29. This movement is represented diagrammatically by arrow F in FIG. 1.

More precisely, the actuator 31 acts on the intermediate part 29 via a drive rod 31*a* whose axis extends parallel to the axis of the production tubing 16.

In the preferred embodiment of the invention shown in the figures, the closure sleeve 26 is mounted on the outside of the production tubing 16. This configuration is preferred because it makes it possible to simplify the device. The actuator 31 can then act on the closure sleeve 26 without needing to pass through the production tubing 16. This makes it possible to omit one of the sealing means, and does not limit the thickness of the closure sleeve 26. In addition, it is simpler to assemble together the various parts because they can be fitted together axially, with the closure sleeve 26 being formed in one piece, and the corresponding segment of production tubing 16 being in one piece as well. However, the flow rate control device 18 of the invention is not limited to this mounting configuration, and it also covers configurations in which the closure sleeve 26 is placed inside the production tubing.

Sealing means are provided on the production tubing 16 on either side of the holes 24 so as to co-operate in fluid-tight manner with the closure sleeve 26 when said sleeve is in its closed state. More precisely, top sealing means 30 are mounted on the tubing 16 above the holes 24, and bottom sealing means 32 are mounted on the tubing 16 below the holes 24.

In the embodiment shown, in which the closure sleeve 26 is placed outside the production tubing 16, the sealing means 30 and 32 are placed in annular grooves formed in the outside surface of the tubing 16 so as to co-operate in fluid-tight manner with the cylindrical inside surface of the closure sleeve 26.

The sealing means 30 and 32 are usually constituted by dynamic sealing gaskets that are annular in shape and that are made of a flexible material such as an elastomer.

In the embodiment shown in FIG. 1, the flow rate control device 18 also includes a protective sleeve 34 below the closure sleeve 26 and in alignment therewith. Essentially, the function of the protective sleeve 34 is to provide continuity in covering the bottom sealing means 32 when the closure sleeve 26 moves upwards, i.e. when the drive means 28 are actuated in the opening direction of the flow rate control device 18.

The flow rate control device 18 also includes return means 36 designed and organized in a manner such as to bring the protective sleeve 34 automatically into a position in which it covers the bottom sealing means 32 when said sealing means do not co-operate with the closure sleeve 26. In the example shown, the return means 36 are implemented in the form of a compression spring.

The return means 36 hold the protective sleeve 34 in abutment against the end of the closure sleeve 26 until the device 18 opens. After which, the protective sleeve 34 comes into abutment against an abutment (not shown) on the production tubing 16 so as to cover the bottom sealing means 32.

Figure 3:
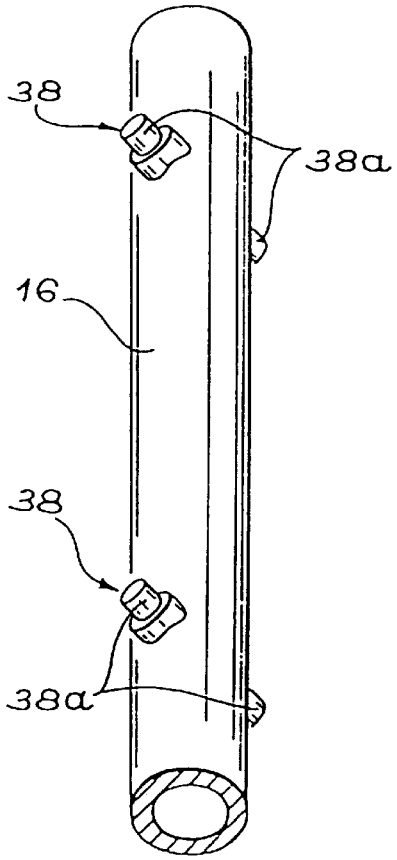
FIG. 3 is a cross-section on line III—III.
Figure 3:
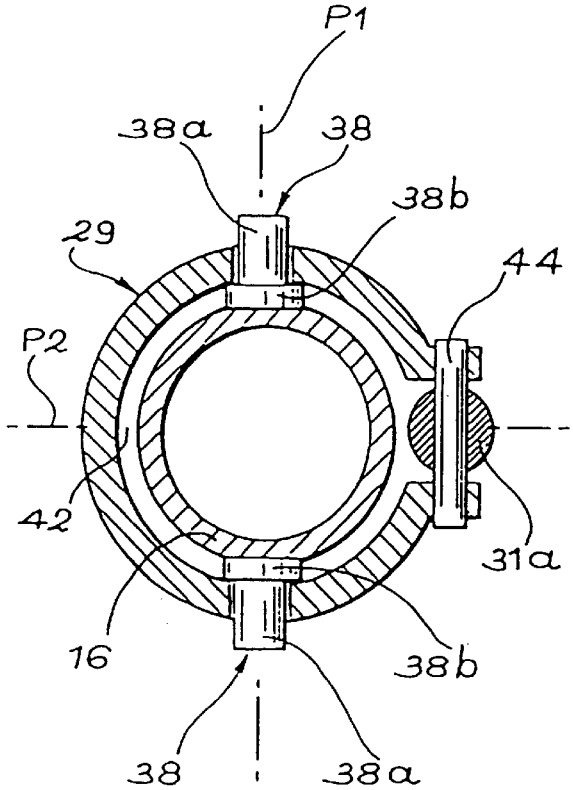
Figure 2:
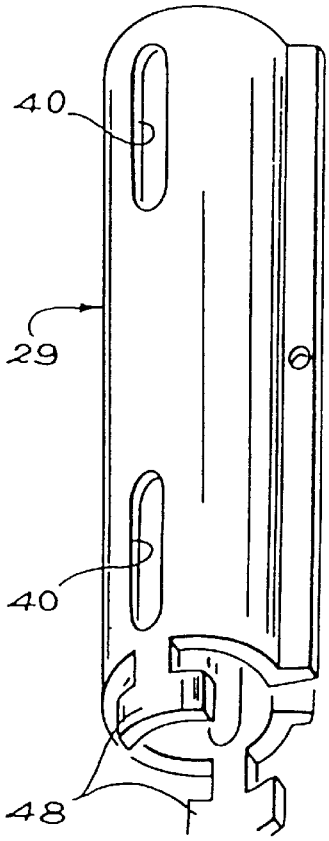
FIG. 2 is an exploded perspective view showing, in particular, the means for guiding the intermediate part on the production tubing.

In the preferred embodiment of the invention, and as shown in more detail in FIGS. 2 and 3, the drive means 28 act on the sleeve 26 via a single intermediate part 29 which is C-shaped in section so as to surround the production tubing 16 over most of its circumference. The intermediate part 29 is guided on the production tubing 16 by guide means allowing the part to move only parallel to the axis of the production tubing.

The guide means comprise four guide members 38 disposed in pairs on either side of the production tubing 16. Each of the guide members 38 includes a removably-mounted cylindrical guide rod 38*a* which projects radially outwards from the production tubing 16. More precisely (FIG. 3), the axes of the four rods 38*a* are situated in a common first plane P1 referred to as the "guide plane" and containing the axis of the production tubing 16. The guide plane extends perpendicularly to a second plane P2 referred to as the "drive plane" and containing both the axis of the production tubing and also the axis of the drive rod 31*a*. The cylindrical rods 38*a* are aligned in pairs and are widely spaced apart from one another along the axis of the production tubing so as to guide the intermediate part 29 accurately.

Each of the guide rods 38*a* passes through a corresponding straight slot 40 formed in the intermediate part 29 and extending parallel to the axis thereof.

As shown in particular in FIGS. 2 and 3, between the guide rod 38*a* and the production tubing 16, each of the guide members 38 further includes a cylindrical base 38*b* constituting a spacer between the intermediate part 29 and the production tubing 16. More precisely, each base 38*b* is in alignment with the rod 38*a* of the corresponding guide member 38, and it has a larger diameter. The outside face of each of the bases 38*b* is thus in abutment against the inside surface of the intermediate part 29, so that circumferential clearance 42 is formed between the part 29 and the production tubing 16. The thickness of the circumferential clearance 42 is determined by the height of each of the bases 38*b*. This thickness is equal, for example, to a few millimeters. Thus, any deposit present on the production tubing 16 has no effect on the movement of the intermediate part 29 around said tubing.

As also shown in FIG. 3, the intermediate part 29 is coupled to the drive rod 31*a* of the actuator by means of a pin 44. More precisely, the pin 44 passes through the drive rod 31 a and through the facing ends of the C-shape formed by the part 29 in section, the pin extending in a direction parallel to the axes of the guide rods 38*a*.

By means of this configuration, the tilting torque generated when the drive means 28 are actuated, because they are installed eccentrically on the production tubing 16, is absorbed entirely by the intermediate part 29. Since the guide rods 38*a* are spaced a long way apart along the axis of the production tubing 16, and are disposed in a guide plane P1 perpendicular to the plane P2 in which the drive rod 31*a* acts, the tilting generated by the eccentricity of the actuator remains very small. In addition, the existence of the circumferential clearance 42 makes it possible to prevent the tilting effect from being amplified by any deposit present on the production tubing 16. Any risk of the device not operating because of the intermediate part 29 jamming is almost completely eliminated.

Furthermore, as shown in particular in FIG. 1, motion is transmitted between the intermediate part 29 and the closure sleeve 26 by coupling means 46 which are designed to be flexible in all directions except over the path followed by the sleeve 26 while it is moving, parallel to the axis of the production tubing 16. In addition, so that the transmission of the motion is accurately centered on the axis of the production tubing, the coupling means 46 are organized symmetrically about the axis.

More precisely, in the embodiment shown in FIGS. 1 to 3, the coupling means 46 are installed in two places disposed symmetrically about the axis of the production tubing 16, in the guide plane P1.

By means of this configuration, the forces applied to the closure sleeve 26 are accurately centered on the axis of the production tubing, regardless of the movement direction.

In the embodiment shown more precisely in FIGS. 1 and 2, the coupling means 48 comprise two T-shaped arms 48 which project downwards parallel to the axis of the tubing 16, at the bottom end of the intermediate part 29. The arms 48 are situated in two places that are diametrically opposite in the guide plane P2. Each of the T-shaped arms 48 is received in a complementary T-shaped notch 50 machined in the top end of the closure sleeve 26. More precisely, the arms 48 and the notches 50 co-operate to provide clearance between the part 29 and the sleeve 26 that is sufficient for small relative movements to be possible in all directions except for the actuating direction, parallel to the axis of the production tubing.

The flexible coupling thus formed between the intermediate part 29 and the closure sleeve 26 makes it possible to decouple the two parts mechanically. Therefore, any slight tilting of the intermediate part 29 due to the eccentricity of the force which is applied to it, is not transmitted to the closure sleeve 26. As a result, the closure sleeve centers itself on the axis of the production tubing and at no time subjects the sealing means 30 and 32 to excessive compression forces or to insufficient compression forces. On the contrary, the compression forces remain permanently substantially constant and uniformly distributed over the entire circumference of the device.

Figure 4:
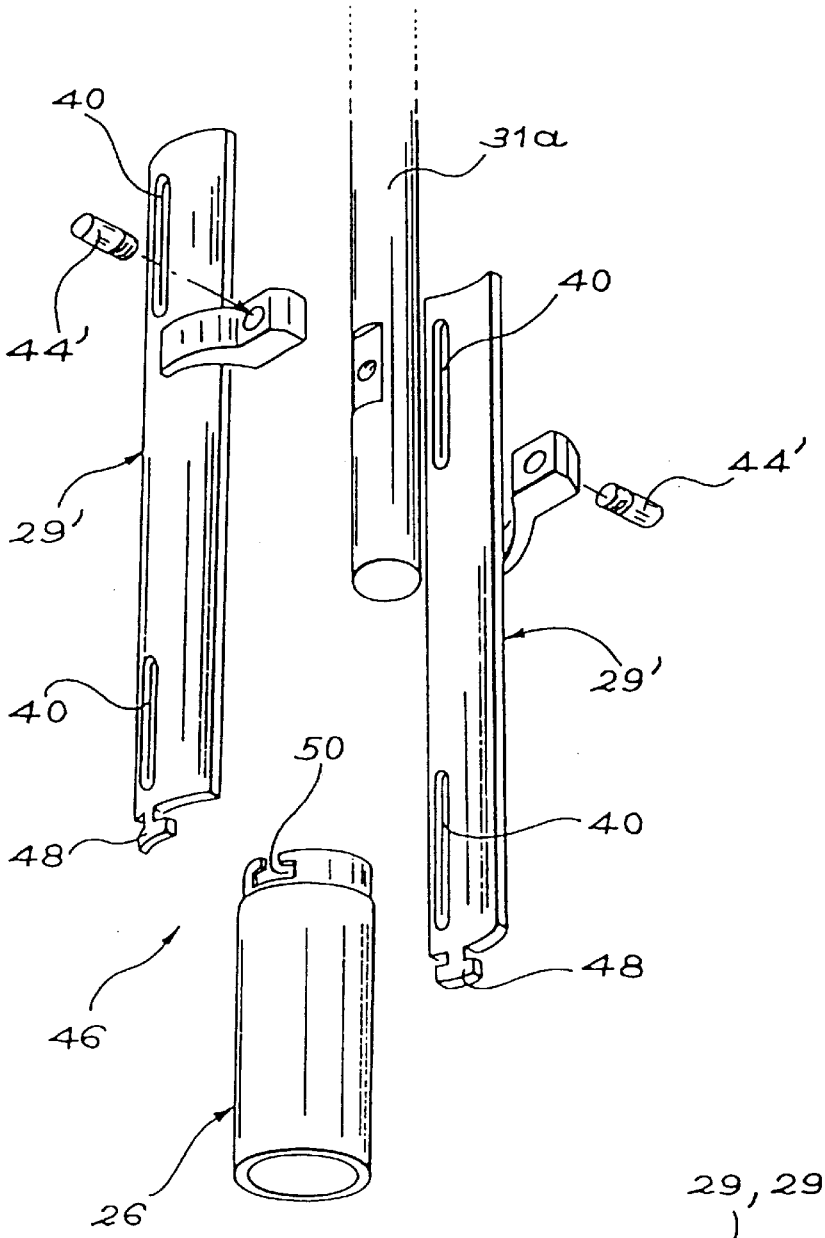
FIG. 4 is an exploded perspective view showing a variant embodiment of the flow rate control device of the invention.

FIG. 4 diagrammatically shows a first variant of the embodiment described above with reference to FIGS. 1 to 3. The originality of this variant lies essentially in the fact that, instead of being transmitted between the drive means 28 and the closure sleeve 26 by a single intermediate part, the forces are transmitted by two intermediate parts 29' disposed symmetrically about the drive plane P2.

In this case, each of the two parts 29' is guided on the production tubing 16 by guide means (not shown) analogous to those described above with reference to FIGS. 2 and 3. More precisely, each of the parts 29' is provided with two straight slots 40 in alignment, and a respective guide rod passes through each slot, which guide rod projects radially outwards from the production tubing 16. In addition a larger diameter base formed at the inner end of each of the guide rods makes it possible to define a relatively large amount of circumferential clearance between each part 29' and the production tubing.

In addition, flexible coupling means 46 are interposed as described above between each of the intermediate parts 29' and the closure sleeve 26.

Furthermore, each of the parts 29' is connected separately to the drive rod 31 a by means of a respective screw pin 44'.

In this variant embodiment, operation of the flow rate control device remains unchanged. In particular, the advantages of reliability resulting particularly from the use of intermediate parts and flexible coupling means are retained.

Figure 5:
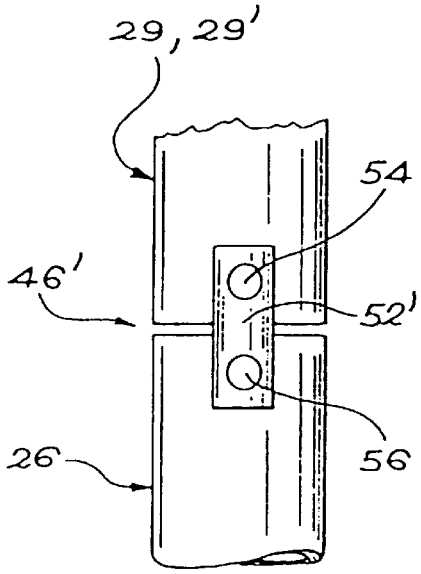
FIG. 5 is a side view showing a variant of the flexible coupling means interposed between the intermediate part and the sleeve.

As shown diagrammatically in FIG. 5, the flexible coupling means may be implemented in various ways without going beyond the ambit of the invention.

Thus, the flexible coupling means 46' may comprise two links 52 disposed symmetrically about the axis of the production tubing 16 in the guide plane P1. Each of the links 52 is hinged to the part 29 or to the corresponding part 29' by a first stud 54. Similarly, each link 52 is hinged to the closure sleeve 26 by a second stud 56. The studs 54 and 56 extend radially relative to the longitudinal axis of the production tubing, and they are both situated in the guide plane P2.

The flexible coupling means 46' formed in this way perform the same functions and offer the same advantages as the flexible coupling means described above with reference to FIG. 1. They can be used either when a single intermediate part 29 is used (FIGS. 1 to 3) or when the drive means 28 act on the sleeve 26 via two intermediate parts 29' (FIG. 4).

Figure 6:
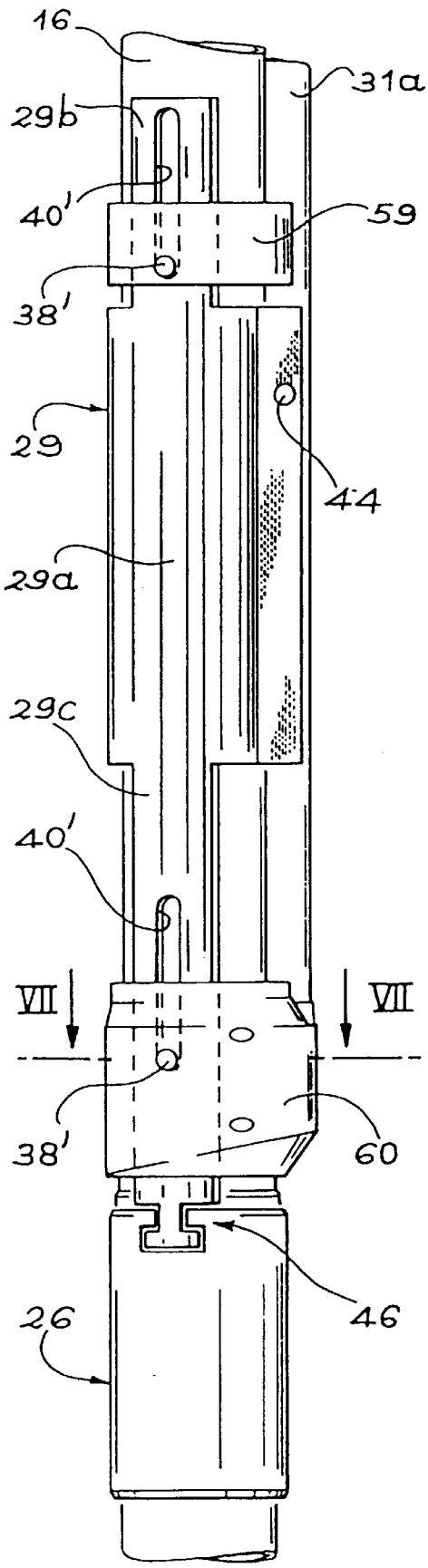
FIG. 6 is a side view which shows another variant embodiment of the flow rate control device of the invention.
Figure 7:
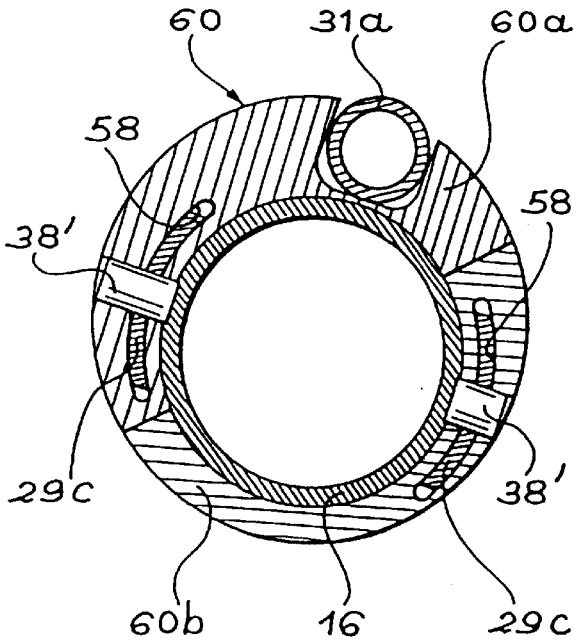
FIG. 7 is a section on line VII—VII shown in FIG. 6.

FIGS. 6 and 7 show another variant embodiment of the invention. The originality of this variant lies essentially in the configuration given to the guide means interposed between the intermediate parts and the production tubing.

In this case, the intermediate part 29 has a central portion 29*a* of C-shaped section, on which the drive rod 31*a* of the actuator acts via a pin 44 as described above. Above and below the central portion 29*a*, the part 29 is provided respectively with two top arms 29*b* and with two bottom arms 29*c* which extend parallel to the axis of the production tubing 16.

Each of the top arms 29*b* passes through a circular arc shaped slideway (not shown), centered on the axis of the tubing 16 and formed in a top guide part 59. In comparable manner, each of the bottom arms 29*c* passes thorough a circular arc shaped slideway 58 (FIG. 7) centered on the axis of the tubing 16 and machined in a bottom guide part 60. The slideways 58 and the arms 29*b*, 29*c* are of the same thickness, so that the intermediate part 29 can slide with almost no clearance along the axis of the production tubing 16.

The guide parts 59 and 60 are fixed to the production tubing 16. In practice, for the purposes of installing the assembly, at least one of the parts 59 and 60 is made in two pieces which are fixed to each other and locked on the tubing 16, e.g. by means of nuts and bolts (not shown). As shown in FIG. 7, the part 60 is made in two pieces which are designated by the references 60*a* and 60*b*.

As above, the arms 29*b* and 29*c* and the parts 59 and 60 co-operate to provide circumferential clearance (not shown) of a few millimeters between the intermediate part 29 and the production tubing 16.

In addition, and as shown more precisely in FIG. 7, respective pairs of cylindrical pins 38' in alignment are mounted in the top guide part 58 and in the bottom guide part 60. The pins 38' extend radially relative to the axis of the production tubing 16, and each of them passes across a corresponding one of the circular arc shaped slideways 58, and through a respective straight slot 40' machined in a respective one of the arms 29*b* and 29*c*.

The pins 38' and the slots 40' co-operate to guide the intermediate part 29 while it is moving as a result of the drive means 28 being actuated.

In addition, in the embodiment shown in FIGS. 6 and 7, the flexible coupling means 46 are comparable to the coupling means described above with reference to FIG. 1. Different coupling means, such as the means 46' described above with reference to FIG. 5 may also be used.

Naturally, the invention is not limited to the embodiments described above by way of example. Thus, in addition to the fact that the device may include one or more coupling parts 29 or 29' and various possible embodiments of the guide means 38, 40 and of the coupling means 46, the invention is also applicable to a device in which the closure sleeve is placed inside the production tubing.

In addition, the path followed by the closure sleeve is not necessarily a path that is exactly parallel to the axis of the production tubing. Thus, this path may, in particular, be a helical path centered on said axis. In which case, the guide means interposed between the intermediate part and the production tubing guarantee that the part moves over this particular path when the drive means are actuated.

Finally, the configuration of the flow rate control device may be totally reversed, without going beyond the ambit of the invention. In which case, the closure sleeve moves downwards in the opening direction, and it is placed above the intermediate part which itself is situated above the drive means.

What is claimed is:

1. A flow control device for controlling the flow rate through tubing placed in an oil well, the tubing including at least one hole therethrough, the device comprising:

a closure sleeve adapted to slide over the tubing hole;

a drive mechanism mounted eccentrically on the tubing and suitable for moving the sleeve over a given path; and at least one intermediate part mounted on the tubing that co-operates with the tubing via a guide mechanism that defines the path and that co-operates with the sleeve via a coupling mechanism that is flexible except along the path and that is disposed symmetrically about the axis of the tubing.

2. A device as in claim 1, wherein the path is parallel to the axis of the tubing.

3. A device as in claim 1, wherein:

the drive mechanism comprises a drive rod extending parallel to the axis of the tubing; and the drive rod acting on the intermediate part.

4. A device as in claim 3, wherein:

the coupling mechanism installed at two places disposed symmetrically about the axis of the tubing in a first plane containing the axis and lying perpendicular to a second plane containing both the axis and the axis of the drive rod.

5. A device as in claim 1, wherein the drive mechanism, the intermediate part, and the closure sleeve are mounted outside the tubing.

6. A device as in claim 5, wherein the intermediate part is connected to the tubing by the guide mechanism so that circumferential clearance is provided between the tubing and the intermediate part.

7. A device as in claim 5 or 6, wherein:

the coupling mechanism installed at two places disposed symmetrically about the axis of the tubing in a first plane containing the axis and lying perpendicular to a second plane containing both the axis and the axis of the drive rod;

the guide mechanism comprises two pairs of guide members;

the guide members in each pair being spaced apart along the axis of the tubing; and the pairs being disposed in the first plane at diametrically opposite places on the tubing.

8. A device as in claim 5, wherein:

the coupling mechanism installed at two places disposed symmetrically about the axis of the tubing in a first plane containing the axis and lying perpendicular to a second plane containing both the axis and the axis of the drive rod;

the guide mechanism comprises two pairs of guide members;

the guide members in each pair being spaced apart along the axis of the tubing;

the pairs being disposed in the first plane at diametrically opposite places on the tubing;

each guide member comprises a cylindrical rod and a base;

the cylindrical rod projecting radially outwards from the tubing through a straight slot formed in the intermediate part; and the base having a relatively larger diameter than the cylindrical rod and whose height determines the circumferential clearance.

9. A device as in claim 5, wherein:

the coupling mechanism installed at two places disposed symmetrically about the axis of the tubing in a first plane containing the axis and lying perpendicular to a second plane containing both the axis and the axis of the drive rod;

the guide mechanism comprises two pairs of guide members;

the guide members in each pair being spaced apart along the axis of the tubing;

the pairs being disposed in the first plane at diametrically opposite places on the tubing;

the guide mechanism comprises two spaced-apart guide parts fixed to the tubing and in which slideways are formed;

the intermediate part including arms which pass through the slideways; and each guide part supporting at least one pin which passes across the slideway and through a straight slot formed in the arm received in the slideway.

10. A device according to any one of claims 7 to 9, wherein at least one intermediate part comprises one C-shaped intermediate part mounted on the tubing.

11. A device according to any of claims 7 to 9, wherein at least one intermediate part comprises two intermediate parts that are symmetrical about the second plane and that are mounted on the tubing.

12. A device as in claim 1, further comprising:

a protective sleeve mounted in alignment with the closure sleeve;

a resilient mechanism adapted to urge the protective sleeve towards the closure sleeve;

so that the resilient mechanism automatically brings the protective sleeve into a covering position in which it covers at least one seal mounted on the tubing on the side of the hole which is distal from the drive mechanism, when the seal is not covered by the closure sleeve.

13. A method of controlling the flow rate through tubing placed in an oil well, the tubing including at least one hole therethrough, the method comprising:

providing a closure sleeve adapted to slide over the tubing hole;

mounting a drive mechanism eccentrically on the tubing suitable for moving the sleeve over a given path; and mounting at least one intermediate part on the tubing that co-operates with the tubing via a guide mechanism that defines the path and that co-operates with the sleeve via a coupling mechanism that is flexible except along the path and that is disposed symmetrically about the axis of the tubing.

14. A well completion, comprising:

a tubing including at least one hole therethrough;

a closure sleeve adapted to slide over the tubing hole;

a drive mechanism mounted eccentrically on the tubing and suitable for moving the sleeve over a given path; and at least one intermediate part mounted on the tubing that co-operates with the tubing via a guide mechanism that defines the path and that co-operates with the sleeve via a coupling mechanism that is flexible except along the path and that is disposed symmetrically about the axis of the tubing.

15. A flow control device for controlling the flow rate through tubing placed in an oil well, the tubing including at least one hole therethrough, the device comprising:

a closure sleeve adapted to slide over the tubing hole;

a drive mechanism mounted ecentrically on the tubing;

an intermediate part mounted on the tubing and attached to the drive mechanism and to the closure sleeve;

the drive mechanism suitable for moving the intermediate part and therefore also moving the closure sleeve over a given path; and the intermediate part adapted to absorb the tilting torque generated by the drive mechanism so that the tilting torque is not transferred to the closure sleeve.

16. A method of controlling the flow rate through tubing placed in an oil well, the tubing including at least one hole therethrough, the method comprising:

providing a closure sleeve adapted to slide over the tubing hole;

mounting a drive mechanism eccentrically on the tubing;

mounting an intermediate part on the tubing, the intermediate part attached to the drive mechanism and to the closure sleeve;

activating the drive mechanism so as to move the intermediate part and therefore also move the closure sleeve over a given path; and absorbing the tilting torque generated by the drive mechanism in the intermediate part so that the tilting torque is not transferred to the closure sleeve.

17. A flow control device for controlling the flow rate through tubing placed in an oil well, the tubing including at least one hole therethrough, the device comprising:

a closure sleeve adapted to slide over the tubing hole;

a drive means mounted eccentrically on the tubing and suitable for moving the sleeve over a given path; and at least one intermediate part mounted on the tubing that co-operates with the tubing via a guide means that defines the path and that co-operates with the sleeve via a coupling means that is flexible except along the path and that is disposed symmetrically about the axis of the tubing.

18. A method of controlling the flow rate through tubing placed in an oil well, the tubing including at least one hole therethrough, the method comprising:

providing a closure sleeve adapted to slide over the tubing hole;

mounting a drive means eccentrically on the tubing suitable for moving the sleeve over a given path; and mounting at least one intermediate part on the tubing that co-operates with the tubing via a guide means that defines the path and that co-operates with the sleeve via a coupling means that is flexible except along the path and that is disposed symmetrically about the axis of the tubing.

19. A well completion, comprising:

a tubing including at least one hole therethrough;

a closure sleeve adapted to slide over the tubing hole;

a drive means mounted eccentrically on the tubing and suitable for moving the sleeve over a given path; and at least one intermediate part mounted on the tubing that co-operates with the tubing via a guide means that defines the path and that co-operates with the sleeve via a coupling means that is flexible except along the path and that is disposed symmetrically about the axis of the tubing.

20. A flow control device for controlling the flow rate through tubing placed in an oil well, the tubing including at least one hole therethrough, the device comprising:

a closure sleeve adapted to slide over the tubing hole;

a drive means mounted ecentrically on the tubing;

an intermediate part mounted on the tubing and attached to the drive means and to the closure sleeve;

the drive means suitable for moving the intermediate part and therefore also moving the closure sleeve over a given path; and the intermediate part adapted to absorb the tilting torque generated by the drive means so that the tilting torque is not transferred to the closure sleeve.

21. A method of controlling the flow rate through tubing placed in an oil well, the tubing including at least one hole therethrough, the method comprising:

providing a closure sleeve adapted to slide over the tubing hole;

mounting a drive means eccentrically on the tubing;

mounting an intermediate part on the tubing, the intermediate part attached to the drive means and to the closure sleeve;

activating the drive means so as to move the intermediate part and therefore also move the closure sleeve over a given path; and absorbing the tilting torque generated by the drive means in the intermediate part so that the tilting torque is not transferred to the closure sleeve.

* * * * *